United States Patent [19]

Girard et al.

[11] 4,133,122

[45] Jan. 9, 1979

[54] CARRIAGE ASSEMBLY FOR AN ELEVATING SCRAPER DUMP LINKAGE AND METHOD OF INSTALLING

[75] Inventors: William T. Girard; Warner G. Richardson; Eugene M. Wilson, all of Joliet, Ill.

[73] Assignee: Caterpillar Tractor Co., Peoria, Ill.

[21] Appl. No.: 824,778

[22] Filed: Aug. 15, 1977

[51] Int. Cl.[2] ..... B21K 1/02; E02F 3/62

[52] U.S. Cl. ..... 37/126 AE; 214/82; 214/514; 211/151; 29/434; 29/148.4 A

[58] Field of Search ..... 37/126 R, 126 AE, 8; 214/82, 510, 514; 211/151; 29/148.4 A, 148.3, 434; 280/31; 212/5, 6, 122

[56] References Cited

U.S. PATENT DOCUMENTS

| | | | |
|---|---|---|---|
| 1,975,327 | 10/1934 | Loney | 211/151 |
| 2,644,588 | 7/1953 | Brown | 211/151 X |
| 3,129,657 | 4/1964 | Farley et al. | 214/82 X |
| 3,739,504 | 6/1973 | Miller | 37/126 AE |
| 3,742,628 | 7/1973 | Walser et al. | 37/126 AE |
| 3,788,507 | 1/1974 | Voss | 214/514 X |
| 3,872,612 | 3/1975 | Gee | 37/8 |
| 3,991,493 | 11/1976 | Orth | 37/126 AE |
| 3,999,267 | 12/1976 | Leskovec et al. | 29/148.4 A |
| 4,041,625 | 8/1977 | Fisher et al. | 37/126 AE |

*Primary Examiner*—E. H. Eickholt
*Attorney, Agent, or Firm*—John W. Grant

[57] ABSTRACT

A carriage assembly has first and second pairs of rollers rotatably connected to first and second sides of the carriage. First and second rail means are secured to spaced parallel sidewalls. The first rail device has first and second elongate rails positioned in end-to-end relationship at which the adjacent ends are spaced one from the other. Each of the first pair of rollers are rollably carried by respective first and second rails while the second pair of rollers are rollably carried by the second rail device.

4 Claims, 4 Drawing Figures

CARRIAGE ASSEMBLY FOR AN ELEVATING SCRAPER DUMP LINKAGE AND METHOD OF INSTALLING

BACKGROUND OF THE INVENTION

Many elevating scrapers have a pivoted floor for emptying the material from a bowl without a separate ejector device. One such scraper has a carriage positioned between the sidewalls of the scraper frame at the rear of the bowl with the carriage being connected to the pivoted floor through a connecting link. The carriage is carried by a plurality of rollers which are rollably positioned within two continuous guide tracks secured to the sidewalls. A hydraulic jack is connected to the carriage to move the carriage between forward and rearward positions to thus pivot the floor between closed and opened positions.

One of the problems encountered therewith is that of installing the carriage initially during the assembly of the scraper at the factory and subsequently disassembly and reinstallation in the field during repair operations. Heretofore, the procedure for installing the carriage has been to position the carriage between the sidewalls and then attach the rollers to the carriage with the rollers being positioned within the respective guide track. As one would expect, such a carriage can weigh several thousand pounds and maintaining the carriage at a fixed position while connecting the rollers to the carriage is extremely difficult particularly when making repairs in the field.

SUMMARY OF THE INVENTION

The present invention is directed to overcoming one or more of the problems as set forth above.

According to the present invention, a carriage assembly has a pair of spaced parallel sidewalls and a carriage positioned between the sidewalls. The carriage has first and second sides and is reciprocable between first and second positions with said first position being spaced from said second position a first preselected distance. First and second pairs of rollers are rotatably connected to respective first and second sides of the carriage. First and second rail means are secured to the respective sidewalls with said first rail means having first and second elongate rails positioned in end-to-end relationship at which the adjacent ends are spaced one from the other a second preselected distance. Each of the first pair of rollers are rollably carried by respective first and second rails while said second pair of rollers are rollably carried by said second rail means. The second preselected distance is sufficient for one roller of the first pair of rollers to pass therethrough. Each of said first and second rails has a length at least equal to said first preselected distance.

DETAILED DESCRIPTION

Figure 1:
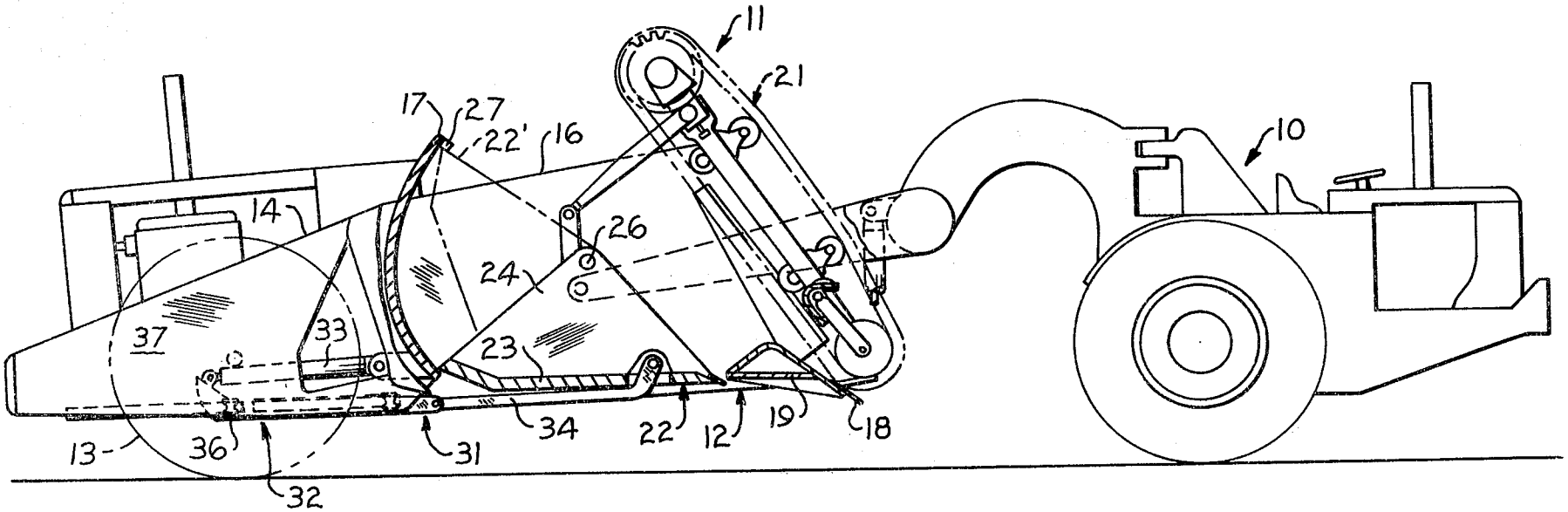
FIG. 1 is a diagrammatic view in partial section of a work vehicle having the apparatus of this invention.

Referring now to FIG. 1, a scraper vehicle is shown having a tractor 10 and a scraper 11 attached conventionally to the tractor. The scraper has a bowl assembly 12 mounted upon a pair of rear wheels, one shown at 13, by means of a rear frame structure 14. The bowl assembly 12 includes a pair of laterally spaced sidewalls 16 and an arcuately shaped rear wall 17. A laterally extending cutting edge 18 is mounted upon a support member 19 which is secured to the sidewalls 16. The cutting edge extends forwardly across the forward edge of the bowl bottom and projects downwardly for cutting material and for guiding such material into the bowl.

Movement of material from the cutting edge 18 is assisted by means of an elevator device shown generally at 21 which has a lower portion situated proximate the cutting edge 18 and slightly forward thereof. The elevator mechanism extends upwardly from the cutting edge and is inclined rearwardly to form the forwardmost boundary of the bowl assembly 12.

The bottom of the bowl assembly 12 is comprised of a pivoting or rotating floor 22 having a lower section 23 which closes the area between the cutting edge support 19 and the lower edge of the arcuate rear wall 17. A pair of laterally spaced triangular side plates, one shown at 24, extend upwardly from the lower section 23 to a pair of pivots, one shown at 26, in the sidewalls 16. The pivots are situated along the locus of centers of curvature for the arcuate rear wall 17. The rotating floor can be rotated clockwise, as shown in the drawings, rearwardly and upwardly to the position shown in phantom at 22' to dump material from the bowl assembly through the bottom thereof when desired. A stop 27 is secured to the rear wall 17 for limiting pivotal movement of the floor. It should be understood that for the purpose of this description and for the following claims, that the terms "rearwardly", "forwardly", "above", "beneath", and so forth, relate to orientations of vehicle components when the vehicle is disposed along a longitudinally extending horizontal plane, as shown in FIG. 1.

An actuating mechanism 31 for the pivoting floor 22 includes a carriage assembly 32, a pair of hydraulic jacks 33, and a connecting link 34.

Figure 2:
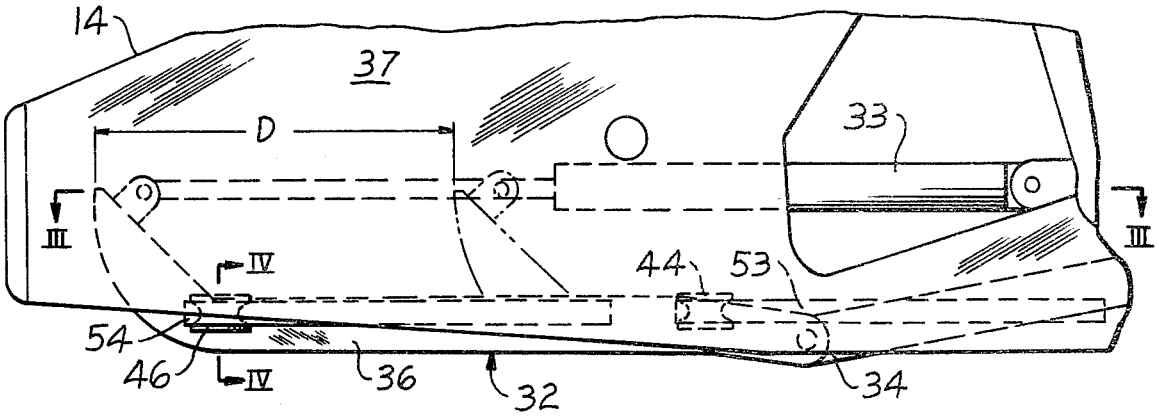
FIG. 2 is a diagrammatic enlarged view of a portion of the vehicle with the carriage in a second position.
Figure 4:
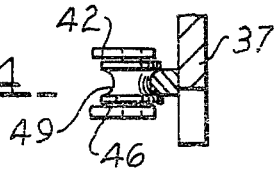
FIG. 4 is a sectional view taken along line IV—IV of FIG. 2.
Figure 3:
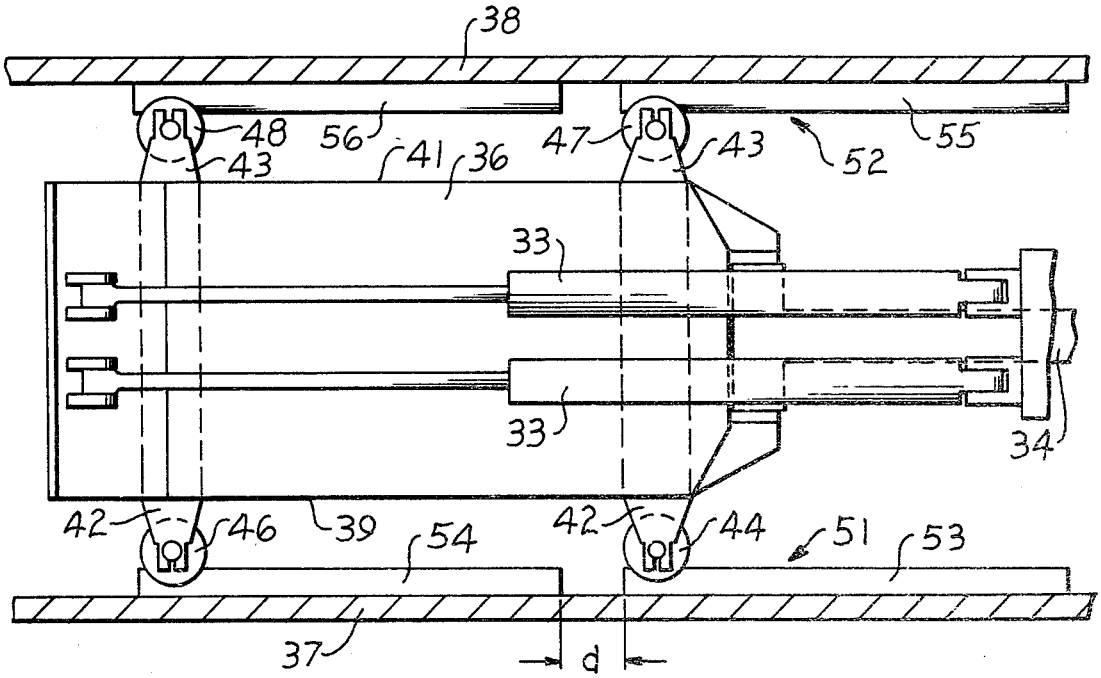
FIG. 3 is a sectional view taken along line III—III of FIG. 2.

Referring to FIGS. 2, 3, and 4, the carriage assembly 32 includes a carriage 36 which is positioned between a pair of sidewalls 37, 38 of the rear frame structure 14 and has first and second sides 39, 41 and first and second pairs of roller mounting brackets 42, 43 extending outwardly from the respective sides. First and second pairs of rollers 44, 46 and 47, 48 are rotatably connected to the distal ends of the first and second pairs of brackets. Each of the rollers has an annular groove 49 in its periphery.

First and second rail means 51, 52 are secured to the sidewalls 37, 38 of the rear frame structure 14. The first rail means has forward and rearward elongate rails 53, 54 positioned in end-to-end relationship with their adjacent ends spaced a preselected distance "d" one from the other. The first pair of rollers 44, 46 are rollably carried by the forward and rearward rails 53, 54, respectively. The second rail means has forward and rearward elongate rails 55, 56 also positioned in end-to-end relationship with their adjacent ends spaced one from the other said preselected distance "d". The second pair of rollers 47, 48 are rollably carried by the forward and rearward rails 55, 56, respectively. The inner edges of the rails are shaped substantially identical to the contour of the annular grooves 49 of the rollers and extend into the annular grooves.

The connecting link 34 has its forward end pivotally connected to the lower section 23 of floor 22 and its rearward end pivotally connected to the forward end of the carriage 36. The hydraulic jacks 33 are pivotally anchored to the rear frame structure 14 and have their rod ends pivotally connected to the rearward end of the carriage.

In the use of the actuating mechanism 31, with the pivoting floor 22 in the position shown in FIG. 1, the hydraulic jacks 33 are in a retracted condition and the carriage 36 is in the position at which the rollers 44, 47 are adjacent the forward end of the rails 53, 55 and the rollers 46, 48 are adjacent the forward ends of rails 54, 56. As shown in FIGS. 2 and 3, extending the hydraulic jacks moves the carriage 36 rearwardly to a position at which the rollers 44, 47 are adjacent the rearward ends of rails 53, 55 and rollers 46, 48 are adjacent the rearward end of rails 54, 56. The rollers ride on the respective rails during movement between the first and second positions of the carriage. The second position is spaced from the first position a preselected distance "D" as indicated in FIG. 2. The length of the rails 53–56 is at least equal to the preselected distance "D" and preferably is greater than the preselected distance "D".

To install the carriage 36 onto the rails 53–56, the carriage is first positioned substantially parallel to and below the forward rails 53, 55 with the rollers 46, 48 positioned in vertical alignment with the space between the forward and rearward rails. In such position, the rollers 44, 47 are positioned forwardly of the forward ends of the forward rails. The carriage is then raised to a position at which the rollers 46, 48 are positioned between the forward and rearward rails. Thus, the length of the forward rails 53, 55 is sufficient for permitting the forward rails to pass between the first and second pair of rollers 44, 46 and 47, 48 respectively. The carriage is then moved rearwardly to a position at which the rollers 44, 47 rollably engage the forward rails 53, 55 and the rollers 46, 48 rollably engage the rearward rails 54, 56 so that the rollers and thus the carriage, is rollably supported by the rails. The hydraulic jacks 33 and connecting link 34 are then connected to the carriage.

Alternatively, the carriage 36 can be installed at the factory with the bowl assembly 12 in an inverted position wherein the carriage is positioned between the sidewalls 37, 38 by lowering the carriage.

Other aspects, objects, and advantages of this invention can be obtained from a study of the drawings, the disclosure, and the appended claims.

The embodiments of the invention in which an exclusive property or privilege is claimed are defined as follows:

1. In a carriage assembly having a pair of spaced parallel sidewalls and a carriage positioned between the sidewalls, said carriage having first and second sides and being reciprocable between first and second positions, said first position being spaced from said second position a first preselected distance, the improvement comprising:

first and second pairs of rollers rotatably connected to respective first and second sides of the carriage; and first and second rail means secured to the respective sidewalls, said first rail means having first and second elongate rails positioned in end-to-end relationship with adjacent ends being spaced one from the other a second preselected distance, said first pair of rollers being rollably carried by respective first and second rails, said second pair of rollers being rollably carried by said second rail means, said second preselected distance being sufficient for positioning of one of the first pair of rollers between the adjacent ends of the first and second rails, each of said first and second rails having a length at least equal to said first preselected distance.

2. The apparatus of claim 1 wherein said first rail has a length greater than said first preselected distance, said length being sufficient for passing the first rail between the first pair of rollers during installation.

3. The apparatus of claim 2 wherein said second rail means includes third and fourth elongate rails positioned in end-to-end relationship with adjacent ends being spaced one from the other said second preselected distance, said second pair of rollers being rollably carried by respective third and fourth rails.

4. A method of installing a carriage between a pair of sidewalls comprising the steps of:

rotatably connecting first and second pairs of rollers to first and second sides of said carriage;

securing first and second rail means to the respective sidewalls;

spacing the adjacent ends of first and second rails of said first rail means one from the other a preselected distance;

positioning the carriage between the sidewalls at a location at which one of the first pair of rollers is positioned between the adjacent ends of said first and second rails; and moving the carriage to a position at which the first pair of rollers rollably engage and are supported by the first and second rails and the second pair of rollers rollably engage and are supported by the second rail means.

* * * * *